US006600393B1

(12) United States Patent
Pahlman et al.

(10) Patent No.: US 6,600,393 B1
(45) Date of Patent: Jul. 29, 2003

(54) TEMPERATURE-COMPENSATED ROD RESONATOR

(75) Inventors: Fredrik Pahlman, Stockholm (SE); Anders Jansson, Taby (SE); Per Hogberg, Taby (SE)

(73) Assignee: Allgon AB, Akersberga (SE)

( * ) Notice: Subject to any disclaimer, the term of this patent is extended or adjusted under 35 U.S.C. 154(b) by 0 days.

(21) Appl. No.: 09/926,695

(22) PCT Filed: Apr. 24, 2000

(86) PCT No.: PCT/SE00/00787

§ 371 (c)(1),
(2), (4) Date: Feb. 26, 2002

(87) PCT Pub. No.: WO00/76019

PCT Pub. Date: Dec. 14, 2000

(30) Foreign Application Priority Data

Jun. 4, 1999 (SE) ..... 9902094

(51) Int. Cl.[7] ..... H01P 7/04; H01P 1/30
(52) U.S. Cl. ..... 333/234; 333/203
(58) Field of Search ..... 333/203, 206, 333/207, 222, 223, 224, 226, 229, 234

(56) References Cited

U.S. PATENT DOCUMENTS 3,414,847 A * 12/1968 Johnson ..... 333/229
4,100,504 A * 7/1978 McGann ..... 333/207
4,292,610 A * 9/1981 Makimoto et al. ..... 333/234
4,380,747 A * 4/1983 Curtinot et al. ..... 333/202
4,423,398 A * 12/1983 Jachowski et al. ..... 333/223
5,304,968 A * 4/1994 Ohtonen et al. ..... 333/222
6,198,363 B1 * 3/2001 Vuoppola et al. ..... 333/202
6,255,917 B1 * 7/2001 Scott ..... 333/206

FOREIGN PATENT DOCUMENTS

JP 52017750 A * 2/1977

* cited by examiner

*Primary Examiner*—Seungsook Ham
(74) *Attorney, Agent, or Firm*—Jacobson Holman PLLC

(57) ABSTRACT

A temperature-compensated rod resonator, comprising a housing (10) having electrically conducting walls, including at least one electrically conductive resonator rod (14) extending from a bottom wall (11) towards a top wall (13), a temperature-compensating plate (20) located adjacent to said top wall (13) and coupling means (150, 151) for transferring electromagnetic energy to and from the resonator. The plate (20) is adapted to change its geometrical configuration in response to temperature variations. The temperature-compensating plate is a bimetallic plate (20) having a larger diameter than the resonator rod (14). A central portion (21) of said bimetallic plate (20) is secured to the upper end of the resonator rod (14), whereby the bimetallic plate, in conjunction with the adjacent top wall (13) defines a capacitance, which has a dominating influence on the resonance frequency. A pheripheral portion (22) of the bimetallic plate (20) is permitted to be freely deflected in response to the temperature variations, whereby the resonance frequency is changed so as to counteract temperature-induced dimensional changes of the housing (10) and the resonator rod (14).

14 Claims, 2 Drawing Sheets

TEMPERATURE-COMPENSATED ROD RESONATOR

This is a nationalization of PCT/SE00/00787, filed Apr. 26, 2000 and published in English.

FIELD OF THE INVENTION

The present invention relates to a temperature-compensated rod resonator, a filter including such a rod resonator, and a bimetallic plate for use in such a rod resonator. More particularly, the invention concerns a rod resonator comprising:

a housing having electrically conducting walls, including side walls, a bottom wall and a top wall, at least one electrically conductive resonator rod extending from said bottom wall towards said top wall, an upper end portion of said rod being located at a predetermined distance from said top wall, so as to define a resonance frequency, a temperature-compensating plate located adjacent to said top wall and being adapted to change its geometrical configuration in response to temperature variations, and coupling means for transferring electromagnetic energy to and from the resonator.

Such rod resonators are especially suitable as structural parts of filters in radio devices.

BACKGROUND OF THE INVENTION-PRIOR ART

There are resonators and filters of many different kinds, e.g., cavity resonators, coaxial resonators with a central rod (for example of the kind specified above), and dielectric filters. In all these kinds of resonators attempts have been made to compensate for dimensional changes caused by temperature variations so as to keep the resonance frequency substantially constant.

A classical method is to combine various materials, having different coefficients of thermal expansion, in various portions of the resonator. Another way is to make use of bimetallic elements to achieve the desired temperature-compensation.

In a cavity resonator disclosed in U.S. Pat. No. 3,414,847 (Johnson), one of the walls defining a box-like cavity, or at least a part of such a wall, is formed by a bimetallic disc which is movable in its entirety in relation to the other walls of the cavity, primarily to enable tuning of the resonator. The disc is mounted on an axially movable plug or shaft, whereby the resonator can be tuned to a desired resonance frequency. The bimetallic disc will change its geometrical shape when the temperature varies, and the structure aims at compensating the temperature-induced dimensional changes by such a change of the shape of the disc. However, since the resonant frequency depends on the total height or length of the cavity, and the distance between the disc and the opposite wall of the cavity is relatively large, the compensating effect will vary with the particular position of the disc obtained when tuning the resonator. Therefore, it is difficult to achieve an exact temperature-compensation. Moreover, the overall dimensions of a cavity resonator of this kind are relatively large, at least in the frequency range of about 1–2 GHz.

A similar device is described in SU-836-711 (Savshinskii), where the compensating element is an elastic, cupola-shaped plate, which is peripherally secured in a metallic holder having a different coefficient of thermal expansion than that of the plate. The flexure of the plate, which is temperature-dependent, will determine the effective length of the cavity. However, the same difficulties appear as in the previous example of prior art.

Similarly,U.S. Pat. No. 3,740,677 (Motorola) discloses a cavity resonator, where a plunger on a shaft is displaceable by means of two bimetallic washers mounted on the shaft. The respective peripheral edges of the washers are secured to opposite sides of the plunger, whereby the plunger will be displaced in its entirety when the washers change their shape in response to temperature variations.

Furthermore, a dielectric resonator with a temperature-compensating bimetallic plate is disclosed in JP-3-22602. Here, the plate is mounted on a tuning screw in opposite relation to a dielectric resonator body having substantially the same diameter as the plate. Of course, in such a dielectric resonator, the major part of the electromagnetic energy is confined within the dielectric or ceramic body. Therefore, the effect of the change of the geometrical configuration of the plate is marginal. Moreover, with a relatively large tuning range, it will be virtually impossible to achieve the desired temperature-compensation so as to maintain the resonance frequency at a substatially constant value.

Another example of prior art resonators with a temperature-compensating plate is the coaxial resonator disclosed in U.S. Pat. No. 5,304,968 (LK-Products OY), which is of the kind defined in the first paragraph above. The centre part of the plate is spaced at a distance from the top wall of the resonator, and the plate has two opposite edge parts attached to the top wall. The coefficients of thermal expansion are different for the top wall and the plate. Therefore, the plate will change its configuration when the temperature varies, whereby the capacitance between the top wall and the free end of the resonator rod will be changed. However, because of the small area of the free end of the rod, it is difficult to achieve a well-defined capacitance and a precise temperature-compensation.

SUMMARY OF THE INVENTION

Against this background, a main object of the present invention is to achieve an improved temperature-compensation of a resonator of the kind defined in the first paragraph so as to keep the resonance frequency at a substantially constant value in spite of inevitable variations in temperature.

A further object is to enable the use of materials which are less temperature stable and to select suitable materials without the requirement of mixing materials having different coefficients of thermal expansion.

A still further object is to permit tuning of the resonant frequency independently of the measures required for temperature-compensation.

Yet another object of the invention is to provide a resonator having small dimensions and which is relatively easy to manufacture.

These objects are achieved for a resonator according to the invention, which has the following features:

The temperature-compensating plate is a bimetallic plate having a larger diameter than the resonator rod. The central portion of the bimetallic plate is secured to the upper end of the resonator rod, whereby the bimetallic plate, in conjunction with the adjacent top wall, defines a capacitance, which has a dominating influence on the resonance frequency while providing a reduction of the geometrical length of the rod compared to a rod without such a plate. Moreover, the peripheral portion of the bimetallic plate is permitted to be freely deflected in response to temperature variations, whereby the capacitance between the bimetallic plate and the top wall is changed so as to counteract temperature-induced dimensional changes of the housing and the resonator rod.

Tests have shown that it is possible to achieve a very stable resonance frequency with a rod resonator having such a structure. Because of the relatively large effective area of the bimetallic plate, the top capacitance (between the plate and the top wall) can be maintained at a high value while keeping a certain minimum distance therebetween, whereby the tolerances of the structural elements (the top wall and the plate) can be held at reasonable levels which facilitate the manufacturing of the resonator.

Also, the power handling capability can be increased because of the relatively large gap between the upper end of the rod and the top wall. So, the risk of a corona breakdown will be lowered.

Basically, the bimetallic plate, at least the central portion thereof, will be stationary because its central portion is fixedly secured to the top end portion of the fixed resonator rod. Even if tuning is carried out, for example by means of a tuning element located at the adjacent top wall, the bimetallic plate and the adjacent top wall are held stationary in relation to each other. Thus, in the region where the temperature compensation is performed, i.e. at the peripheral portion of the bimetallic plate, there will be no change as a consequence of the tuning process. Therefore, the temperature compensation will be substantially uneffected by the tuning.

It has turned out that the manufacture of a rod resonator according to the invention is relatively easy and inexpensive. The housing can be made of aluminium in a moulding process, and the materials for other parts of the resonator can be selected at will without considering the various coefficients of thermal expansion.

Moreover, thanks to the relatively short geometrical length of the resonator rod, the overall dimensions of the resonator, and any filter containing one or more such resonators, will be small. Of course, this is a great advantage in many practical applications, such as radio devices, for example in base stations for mobile telephone systems and the like.

From a practical point of view, it may also be advantageous to use plastic materials, coated with an electrically conductive material, for the housing and possibly also the resonator rod. Of course, the rod may be made of a different material than the housing as long as the surface portion thereof is electrically conducting.

As indicated above, it is important that the bimetallic plate is securely fastened to the top end portion of the resonator rod. This can be accomplished in a practical manner by making the bimetallic plate in the form of a ring member with a hole corresponding substantially to the cross-sectional shape of the resonator rod (at the upper end portion thereof—in principle, the resonator rod may have a cross-section which is different at various longitudinal sections thereof). A preferred way of securing the plate is to use a rivet connection. These and other further features will appear from the appended claims.

The invention will be described more fully below with reference to the drawings, which illustrate some preferred embodiments of the invention.

DETAILED DESCRIPTION OF PREFERRED EMBODIMENTS

Figure 1:
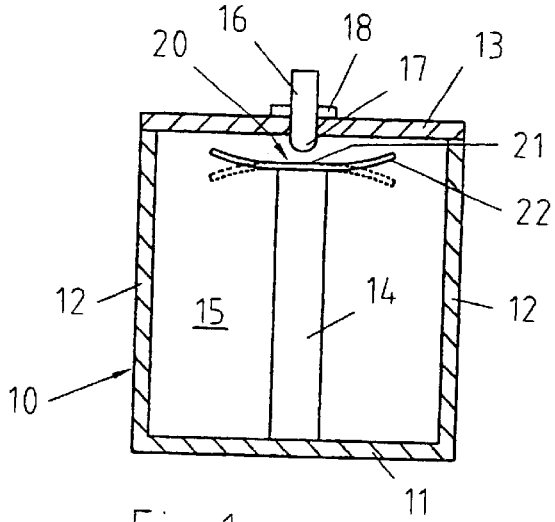
FIG. 1 shows, in a schematic sectional side view, a rod resonator according to a first embodiment.
Figure 2:
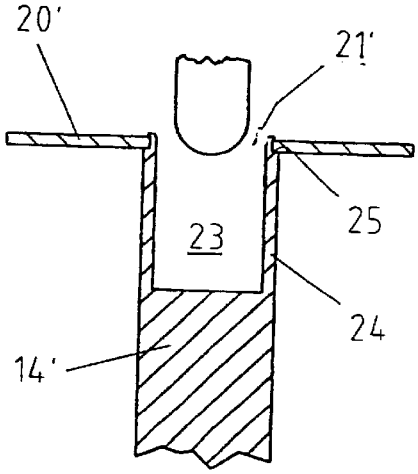
FIGS. 2 through 5 show, in partial views to a larger scale, various modifications of the connection between the rod and the bimetallic plate included in the rod resonator of FIG. 1.

The resonator illustrated in FIG. 1 comprises a cylindrical or box-like housing 10 including a bottom wall 11, side walls 12 and a top wall 13, formed as lid, as well as a central resonator rod 14, normally having an electrical length corresponding to a quarter of the wave-length (at the normal operating resonant frequency). The walls 11–13 of the housing 10 as well as the rod 14 can be made of an electrically conducting material, e.g., a metallic material, such as Al. Alternatively, these elements can be made of a plastic material coated with an electrically conductive material at the inside, so that the cavity 15 formed within the housing 10 is defined by electrically conducting wall surfaces. The resonator described so far is a coaxial resonator wherein an electro-magnetic field can be excited at a resonant frequency by connecting the resonator to input and output coupling means (not shown in FIG. 1), as is known per se. Thus, the resonator can be used as a band pass filter with a pass band centered around the resonant frequency.

As is also known to those skilled in the art, there is a tuning assembly 16 at the central portion of the top wall 13, including a tuning screw 17 and a locking nut 18. Hereby, the resonant frequency can be tuned to a desired value within certain limits.

According to the invention, a bimetallic plate 20 is mounted at the top end portion of the resonator rod 14 in order to achieve temperature-compensation. The central portion 21 of the plate 20 is securely fastened to the rod 14, whereas the peripheral portion 22 thereof is permitted to deflect freely upwards and downwards in response to temperature variations, as indicated by the dotted lines in FIG. 1. Hereby, the temperature-induced dimensional changes of the housing 10 and the rod 14 will be counter-acted, so as to substantially reduce or even eliminate an associated change of the resonant frequency, as discussed above. Also, the length of the rod 14 and the overall dimensions of the resonator are reduced thanks to the plate 20.

The outer diameter of the bimetallic plate 20 should be larger than the diameter of rod 14, preferably 1.5 to 4 times the latter diameter, in order to obtain the advantageous effects mentioned above.

Preferably, as illustrated in FIGS. 2–5, the plate is a ring member 20', 20" having a central hole 21', which corresponds substantially to the cross-sectional shape of the resonator rod 14', 14". Advantageously, the upper end portion of the rod 14' has a central recess or bore 23 which can partially accommodate the tuning screw 17, if necessary, without making contact with the latter.

The bore 23 will define an upper sleeve portion 24 of the rod 14', provided with an abutment shoulder 25 formed by an external recess at the top of the sleeve portion 24. Hereby, the bimetallic ring member 20' will be seated in a well-defined position. A secure fixation of the ring member can be achieved by deforming the material of the sleeve portion 24 against the inner edge of the hole 21'.

Figure 3:
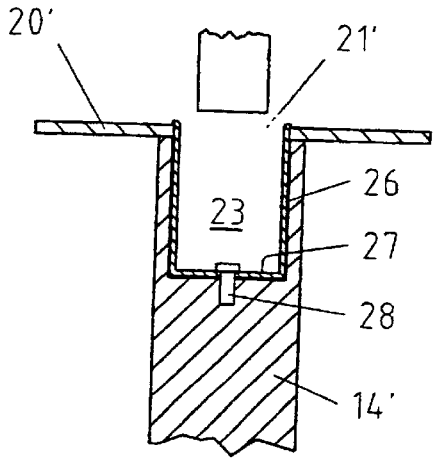

As an alternative, a separate bushing 26 can be inserted into the central recess 23. As shown in FIG. 3, a bottom flange or wall 27 is secured to the bottom of the recess 23 by means of a fastening screw 28.

Figure 4:
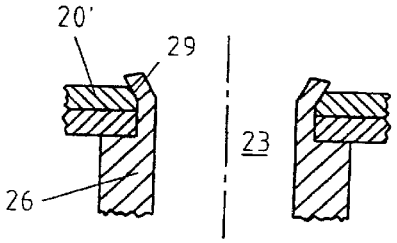

The ring member 20' may be bevelled at the upper edge of the hole 21',as shown at 29 in FIG. 4, whereby the riveting of the sleeve 24 or bushing 26 is facilitated and the secure holding of the ring member in a fixed position is achieved.

Figure 5:
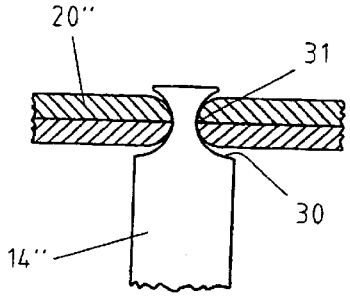

A further modification of the connection between the rod 14" and the plate 20" is shown in FIG. 5, where a massive upper portion of the rod 14" is provided with an external circumferential groove 30 having a curved cross-section. The ring member 20" has a rounded inner edge 31, which fits into the groove 30 and holds the ring member 20" in position while permitting a bending movement thereof.

Figure 6:
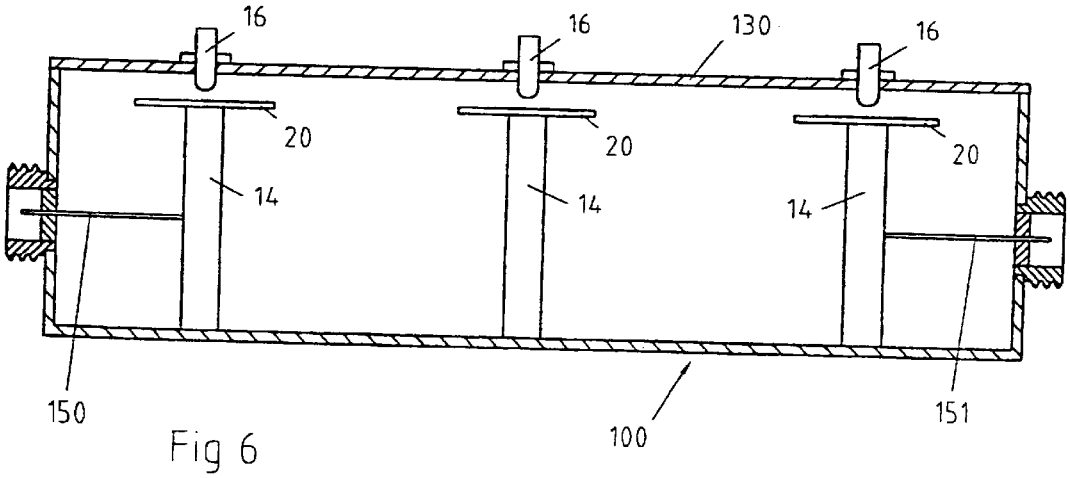
FIG. 6 shows, likewise in a schematic sectional side view, a second embodiment of the resonator including three rods.

FIG. 6 illustrates a second embodiment of a resonator according to the invention, provided with three resonator rods 14 in a row in the same housing 100. Each resonator rod 14 has a bimetallic plate 20, and a tuning assembly 16 is disposed opposite to the respective resonator rod 14 in the top wall 130. Input and output means 150, 151 are also shown in FIG. 6.

Thus, a filter may be composed of a number of resonator rods in a housing. The various rods do not have to be located along a straight line but in any desired configuration. The configuration of the housing, defining a cavity with one or any desired number of resonator rods, may also be chosen at will.

The bimetallic plate does not have to be circular but may be square, polygonal or of any other form, preferably symmetrical with respect to the axis of the resonator rod. As indicated above, the centre portion of the bimetallic plate may be massive or provided with a central hole. Also, the bimetallic plate does not have to be planar in its rest position but may be wholly or partially curved, e.g., as a bowl.

What is claimed is:

1. A temperature-compensated rod resonator, comprising:

a housing having electrically conducting walls, including side walls, a bottom wall and a top wall, at least one electrically conductive resonator rod extending from said bottom wall towards said top wall, an upper end portion of said rod being located at a predetermined distance from said top wall, to define a resonance frequency, a temperature-compensating plate located adjacent to said top wall and being adapted to change geometrical configuration in response to temperature variations, and coupling means for transferring electro-magnetic energy to and from the resonator, said temperature-compensating plate is a bimetallic plate having a larger diameter than said resonator rod, a central portion of said bimetallic plate being secured to said upper end of said resonator rod, the bimetallic plate, in conjunction with the adjacent top wall defines a capacitance, which has a dominating influence on said resonance frequency, a peripheral portion of said bimetallic plate being permitted to be freely deflected in response to said temperature variations, and capacitance between the bimetallic plate and said top wall is changed to counteract temperature-induced dimensional changes of said housing and said resonator rod.

2. The rod resonator is defined in claim 1, wherein the diameter of said bimetallic plate is 1.5 to 4 times the diameter of said resonator rod.

3. The rod resonator as defined in claim 1, wherein said bimetallic plate is a ring member with a hole corresponding substantially to the cross-sectional shape of said resonator rod.

4. The rod resonator as defined in claim 3, wherein a tuning member is disposed in said top wall opposite to said bimetallic ring member, and wherein said upper end portion of said resonator rod has a central recess with a diameter being substantially larger than the diameter of said tuning member.

5. The rod resonator as defined in claim 4, wherein the bimetallic ring member is mechanically secured to said upper end portion of said resonator rod by a sleeve portion extending axially through the hole of the bimetallic ring member.

6. The rod resonator as defined in claim e wherein said bimetallic ring member is secured to said resonator rod by a rivet connection.

7. The rod resonator as defined in claim 5, wherein an upper part of said resonator rod comprises a sleeve portion, the external circumferential surface of which is recessed so as to form an abutment shoulder for positioning said bimetallic ring member onto said resonator rod.

8. The rod resonator as defined in claim 5, wherein said sleeve portion is a separate bushing having an upper flange and being secured at its lower end to the bottom portion of said central recess in the resonator rod.

9. The rod resonator as defined in claim 8, wherein said bushing has a bottom flange with a hole for a screw fastener.

10. The rod resonator as defined in claim 6, wherein said bimetallic ring member has a beveled edge portion at the upper part of said hole.

11. The rod resonator as defined in claim 3, wherein the hole of said bimetallic ring member is seated in a circumferential groove in a cylindrical external surface of said resonator rod.

12. The rod resonator as defined in claim 11, wherein a inner edge portion, which defines said hole of said bimetallic ring member, and said circumferential groove both have a curved cross-sectional shape.

13. A filter including at least one rod resonator as claimed in claim 1.

14. The rod resonator as defined in claim 8, wherein said bushing has a wall with a hole for a screw fastener.

* * * * *

UNITED STATES PATENT AND TRADEMARK OFFICE

CERTIFICATE OF CORRECTION

PATENT NO. : 6,600,393 B1
DATED : July 29, 2003
INVENTOR(S) : Pahlman et al.

It is certified that error appears in the above-identified patent and that said Letters Patent is hereby corrected as shown below:

Title page,
Item [22], PCT Filed: please change "Apr. 24, 2000" to -- Apr. 26, 2000 --.

Signed and Sealed this

Eleventh Day of May, 2004

JON W. DUDAS
*Acting Director of the United States Patent and Trademark Office*